US010395523B2

(12) United States Patent
Radomy et al.

(10) Patent No.: US 10,395,523 B2
(45) **Date of Patent: *Aug. 27, 2019**

(54) METHOD, APPARATUS AND COMPUTER PROGRAM PRODUCT FOR INDEXING TRAFFIC LANES FOR SIGNAL CONTROL AND TRAFFIC FLOW MANAGEMENT

(71) Applicant: HERE Global B.V., Eindhoven (NL)

(72) Inventors: Samuel Radomy, Chicago, IL (US); Jingwei Xu, Buffalo Grove, IL (US); Weimin Huang, Summit, NJ (US); Bruce Bernhardt, Waconda, IL (US)

(73) Assignee: HERE Global B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/180,760

(22) Filed: Nov. 5, 2018

(65) Prior Publication Data

US 2019/0073899 A1 Mar. 7, 2019

Related U.S. Application Data

(63) Continuation of application No. 15/262,288, filed on Sep. 12, 2016, now Pat. No. 10,147,316.

(51) Int. Cl.
*G08G 1/01* (2006.01)
*G08G 1/07* (2006.01)

(52) U.S. Cl.
CPC ..... *G08G 1/0145* (2013.01); *G08G 1/07* (2013.01)

(58) Field of Classification Search
CPC ..... G08G 1/0145; G08G 1/07
See application file for complete search history.

(56) References Cited

U.S. PATENT DOCUMENTS 6,226,590 B1 5/2001 Fukaya et al.
8,560,231 B2 10/2013 Vu et al.
(Continued)

OTHER PUBLICATIONS

Haversine formula—Wikipedia [online] [retrieved Jan. 5, 2017]. Retrieved from the Internet: <URL: https://en.wikipedia.org/wiki/Haversine_formula>. (dated Dec. 10, 2016) 5 pages.
(Continued)

*Primary Examiner* — Sisay Yacob
(74) *Attorney, Agent, or Firm* — Alston & Bird LLP

(57) ABSTRACT

A method is provided for identifying and indexing lanes of an intersection. Methods may include: determining a directionality for one or more lanes for each of two or more roadways proximate an intersection, where directionality is one of toward the intersection or away from the intersection; determining a bearing for each lane of the two or more roadways proximate the intersection, where the bearing includes a compass heading informed by the directionality; determining a lane position for each lane of the two or more roadways proximate the intersection; generating an order of the lanes using a hierarchy, where the hierarchy considers directionality first, bearing second, and lane position third; causing the generated order of the lanes to be stored in a memory, where the order of the lanes is associated with the intersection; and managing signal phase and timing of the intersection using the generated order of the lanes.

20 Claims, 6 Drawing Sheets

(56) References Cited

U.S. PATENT DOCUMENTS

| | | | | |
|---|---|---|---|---|
| 2006/0155427 | A1* | 7/2006 | Yang | G08G 1/07 701/1 |
| 2008/0086258 | A1* | 4/2008 | Wall | G08G 1/081 701/117 |
| 2009/0210151 | A1 | 8/2009 | Toyoda | |
| 2010/0060483 | A1* | 3/2010 | McNew | G08G 1/164 340/907 |
| 2011/0054783 | A1 | 3/2011 | Kishikawa et al. | |
| 2011/0125402 | A1 | 5/2011 | Mitsugi et al. | |
| 2016/0027299 | A1 | 1/2016 | Raamot | |
| 2016/0027300 | A1* | 1/2016 | Raamot | G08G 1/08 340/922 |

OTHER PUBLICATIONS

Vincenty's formulae—Wikipedia [online] [retrieved Jan. 5, 2017]. Retrieved from the Internet: <URL: https://en.wikipedia.org/wiki/Vincenty's_formulae>. (dated Dec. 10, 2016) 5 pages.

Urbanik, T. et al., *Introduction to Timing Plans* (Chapter 5), NCHRP Report 812, Signal Timing Manual, Second Edition (dated 2015) pp. 5-1 through 5-3.

ITS Standards Fact Sheets, Deployment Resources, SAE J2735—Dedicated Short Range Communications (DSRC) Message Set Dictionary [online] [retrieved Jan. 5, 2017]. Retrieved from the Internet: <URL: https://www.standards.its.dot.gov/Factsheets/Factsheet/71>. (dated Sep. 25, 2009) 2 pages.

Invitation to Pay Additional Fees with Partial International Search Report and Provisional Opinion for International Patent Application No. PCT/IB2017/055143 dated Dec. 19, 2017, 16 pages.

International Search Report and Written Opinion for Application No. PCT/IB2017/055143 dated Feb. 12, 2008, 16 pages.

Office Action for U.S. Appl. No. 15/262,288 dated Jan. 11, 2018, 14 pages.

Notice of Allowance for U.S. Appl. No. 15/262,288 dated Aug. 8, 2018.

* cited by examiner

METHOD, APPARATUS AND COMPUTER PROGRAM PRODUCT FOR INDEXING TRAFFIC LANES FOR SIGNAL CONTROL AND TRAFFIC FLOW MANAGEMENT

CROSS-REFERENCE TO RELATED APPLICATIONS

This application is a continuation of and claims priority to U.S. patent application Ser. No. 15/262,288, filed on Sep. 12, 2016, the contents of which are hereby incorporated by reference in their entirety.

TECHNICAL FIELD

Example embodiments of the present invention relate generally to identifying and indexing traffic lanes of an intersection, and more particularly, to indexing traffic lanes through a well-defined, deterministic methodology to facilitate signal control and timing and traffic flow management through the respective intersections.

BACKGROUND

The modern communications era has brought about a tremendous expansion of wireline and wireless networks. Computer networks, television networks, and telephone networks are experiencing an unprecedented technological expansion, fueled by consumer demand. Wireless and mobile networking technologies have addressed consumer demands while providing more flexibility and immediacy of information transfer. Municipal infrastructure has also benefited from networking technology, such as the networking of traffic control signals to facilitate traffic flow through intersections and along routes.

In the area of traffic control, intersections play a critical role in traffic flow management. Intersections having traffic control signals provide intersection movement state control strategies to ensure vehicle capacity and safety on the roads. Traffic agencies and transportation departments may control traffic flow through traffic signal timing and management. However, complex intersections involving a plurality of lanes may be more difficult to model and manage when creating traffic management plans and adjusting traffic signal phase timing.

BRIEF SUMMARY

In general, example embodiments of the present invention provide an improved method of traffic lane identification for signal control management and traffic flow management. According to an example embodiment, an apparatus may be provided including at least one processor and at least one memory including computer program code stored thereon. The at least one memory and the computer program code configured to, with the at least one processor, cause the apparatus to: determine a directionality for one or more lanes for each of two or more roadways proximate an intersection, where directionality is one of toward the intersection or away from the intersection; determine a bearing for each lane of the two or more roadways proximate the intersection, where the bearing includes a compass heading informed by the directionality; determine a lane position for each lane of the two or more roadways proximate the intersection; cause the generated order of the lanes to be stored in a memory, where the order of the lanes is associated with the intersection; and manage signal phase and timing of the intersection using the generated order of the lanes.

According to some embodiments, causing the apparatus to determine a bearing of each of the lanes may include causing the apparatus to: determine, for each lane, a compass bearing of a vector direction of the lane; and assign a value to the compass bearing for each lane. The cardinal direction north may have a value of zero, and the assigned value to the compass bearing for each lane may include a degree measurement from north between zero and a finite unit of measure less than 360 degrees, where the finite unit of measure is the measurable tolerance of the determined compass bearing. Causing the apparatus to generate an order of the lanes using the hierarchy may include causing the apparatus to: sort the lanes according to directionality, with the lane directionality toward the intersection being prioritized ahead of lane directionality away from the intersection; sort the lanes sorted by directionality by bearing, where a lower bearing value is prioritized over a higher bearing value; and sort the lanes according to lane order from inner most lane to outer most lane, or from outer most lane to inner most lane.

According to some embodiments, causing the apparatus to generate an order of the lanes using the hierarchy may include causing the apparatus to prioritize all lanes with a directionality toward the intersection head of all lanes with a directionality away from the intersection. Directionality for one or more lanes for each of two or more roadways proximate an intersection may be established in response to probe data from vehicles traveling through the intersection. The bearing for each lane of the two or more roadways proximate the intersection may be established in response to probe data from vehicles traveling through the intersection.

Embodiments of the present invention may provide a method including: determining a directionality for one or more lanes for each of two or more roadways proximate an intersection, where directionality is one of toward the intersection or away from the intersection; determining a bearing for each lane of the two or more roadways proximate the intersection, where the bearing includes a compass heading informed by the directionality; determining a lane position for each lane of the two or more roadways proximate the intersection; generating an order of the lanes using a hierarchy, where the hierarchy considers directionality first, bearing second, and lane position third; causing the generated order of the lanes to be stored in a memory, where the order of the lanes is associated with the intersection; and managing signal phase and timing of the intersection using the generated order of the lanes. Determining a bearing of each lane may include: determining, for each lane, a compass bearing of a vector direction of the lane; and assigning a value to the compass bearing for each lane. The cardinal direction north may have a value of zero, and the assigned value to the compass bearing for each lane may include a degree measurement from north between zero and a finite unit of measure less than 360 degrees, where the finite unit of measure is the measurable tolerance of the determined compass bearing.

According to some embodiments, generating an order of the lanes using the hierarchy may include: sorting the lanes according to directionality, with lane directionality toward the intersection being prioritized ahead of lane directionality away from the intersection; sorting the lanes sorted by directionality by bearing, where lower bearing values are prioritized over higher bearing values; and sorting the lanes according to lane order from outer most lane to inner most lane or from inner most lane to outer most lane. Generating an order of the lanes using the hierarchy may include prioritizing all lanes with a directionality toward the intersection ahead of all lanes with a directionality away from the intersection. Directionality for one or more lanes for each of two or more roadways proximate an intersection may be established in response to probe data from vehicles traveling through the intersection. The bearing for each lane of the two or more roadways proximate the intersection are established in response to probe data from vehicles traveling through the intersection.

Embodiments of the present invention may provide a computer program product having at least one non-transitory computer-readable storage medium having computer-executable program code instructions stored therein. The computer-executable program code instructions may program code instructions to: determine a directionality for one or more lanes for each of two or more roadways proximate an intersection, where directionality is one of toward the intersection or away from the intersection; determine a bearing for each lane of the two or more roadways proximate the intersection, where the bearing includes a compass heading informed by the directionality; determine a lane position for each lane of the two or more roadways proximate the intersection; generate an order of the lanes using a hierarchy, where the hierarchy considers directionality first, bearing second, and lane position third; cause the generated order of the lanes to be stored in a memory, where the order of the lanes is associated with an intersection; and manage signal phase and timing of the intersection using the generated order of the lanes.

According to some embodiments, the program code instructions to determine a bearing of each lane includes program code instructions to: determine, for each lane, a compass bearing of a vector direction of the lane; and assign a value to the compass bearing for each lane. The cardinal direction north may have a value of zero, and the assigned value to the compass bearing for each lane may include a degree measurement from north between zero and a finite unit of measure less than 360 degree, wherein the finite unit of measure is the measurable tolerance of the determined compass bearing.

According to some embodiments, the program code instructions to generate an order of the lanes using the hierarchy may include program code instructions to: sort the lanes according to directionality, with lane directionality toward the intersection prioritized ahead of lane directionality away from the intersection; sort the lanes sorted by directionality by bearing, where lower bearing values are prioritized over higher bearing values; and sort the lanes according to lane order from outer most lane to inner most lane or from inner most lane to outer most lane. The program code instructions to generate an order of the lanes using the hierarchy may include program code instructions to prioritize all lanes with a directionality toward the intersection ahead of all lanes with a directionality away from the intersection. Directionality for one or more lanes for each of two or more roadways proximate an intersection may be established in response to probe data from vehicles traveling through the intersection.

BRIEF DESCRIPTION OF THE DRAWINGS

Figure 1:
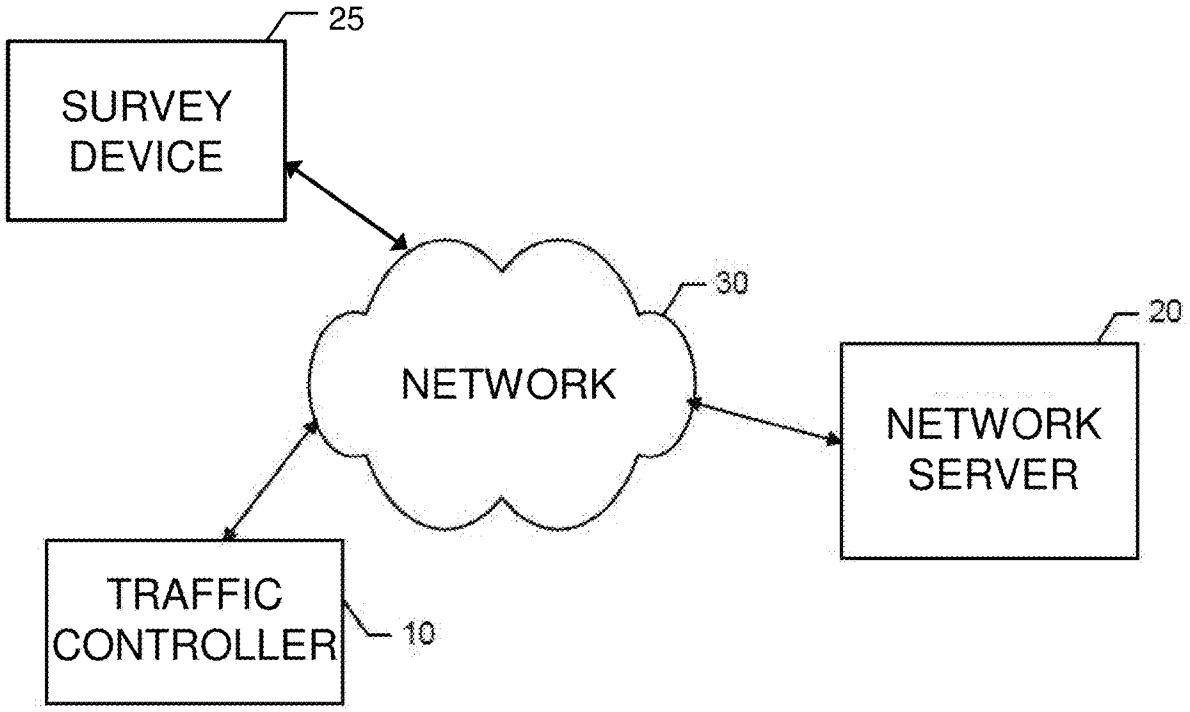
Figure 2:
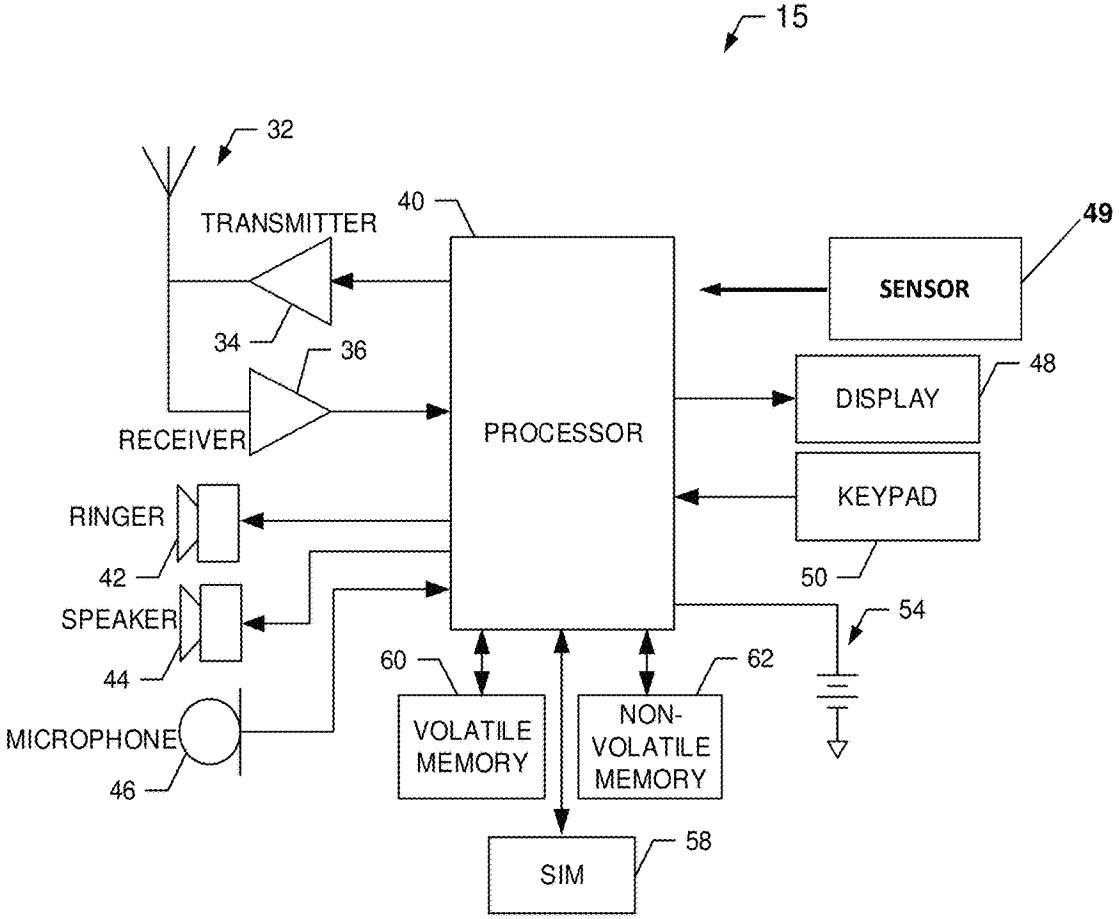
Figure 3:
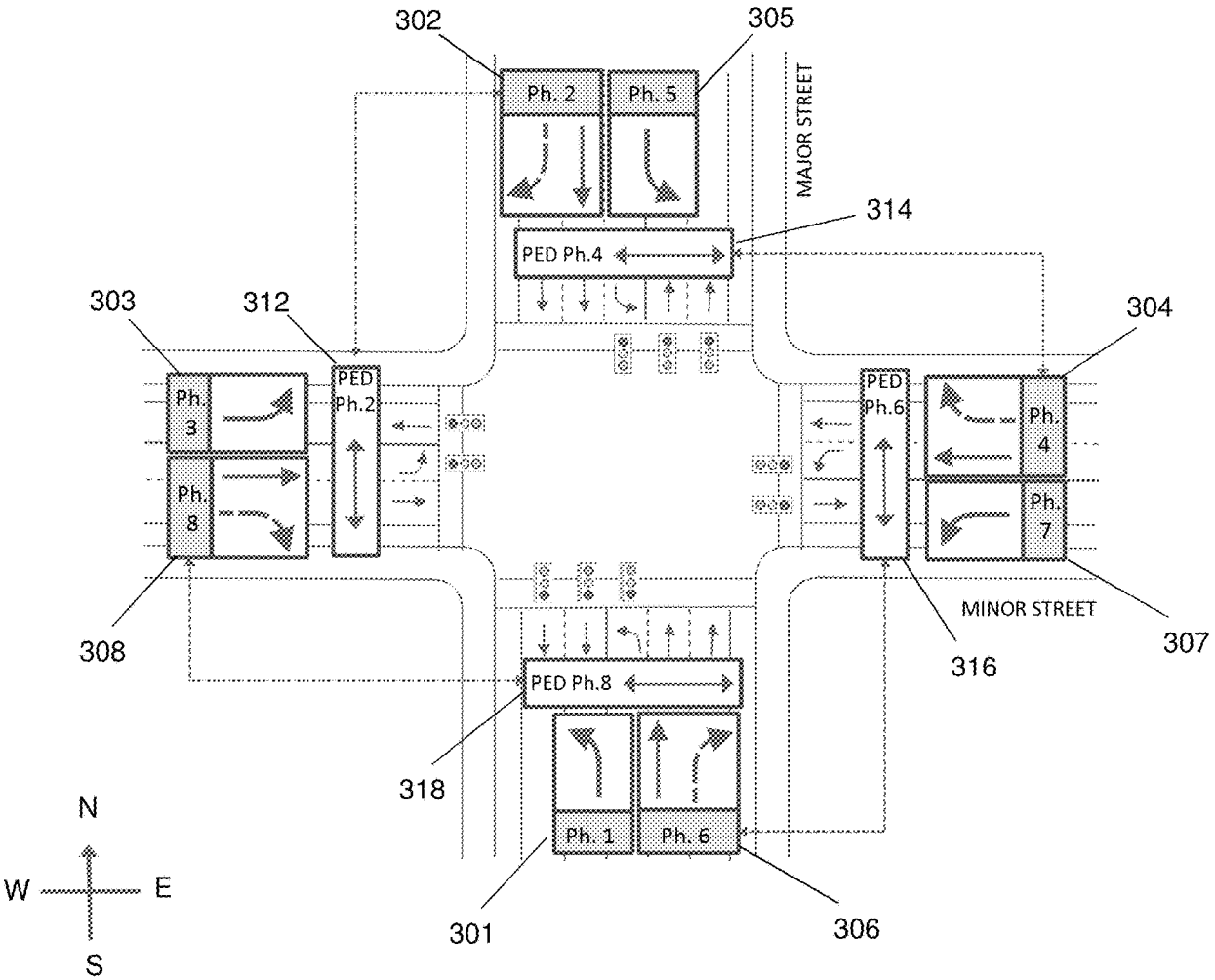
Figure 4:
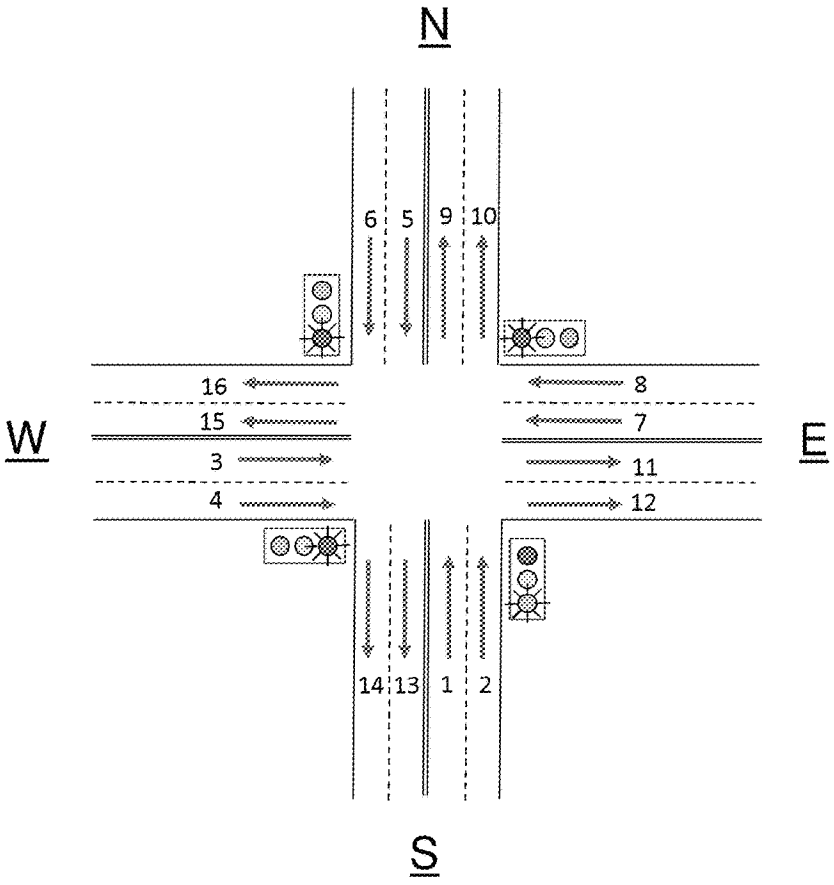
Figure 5:
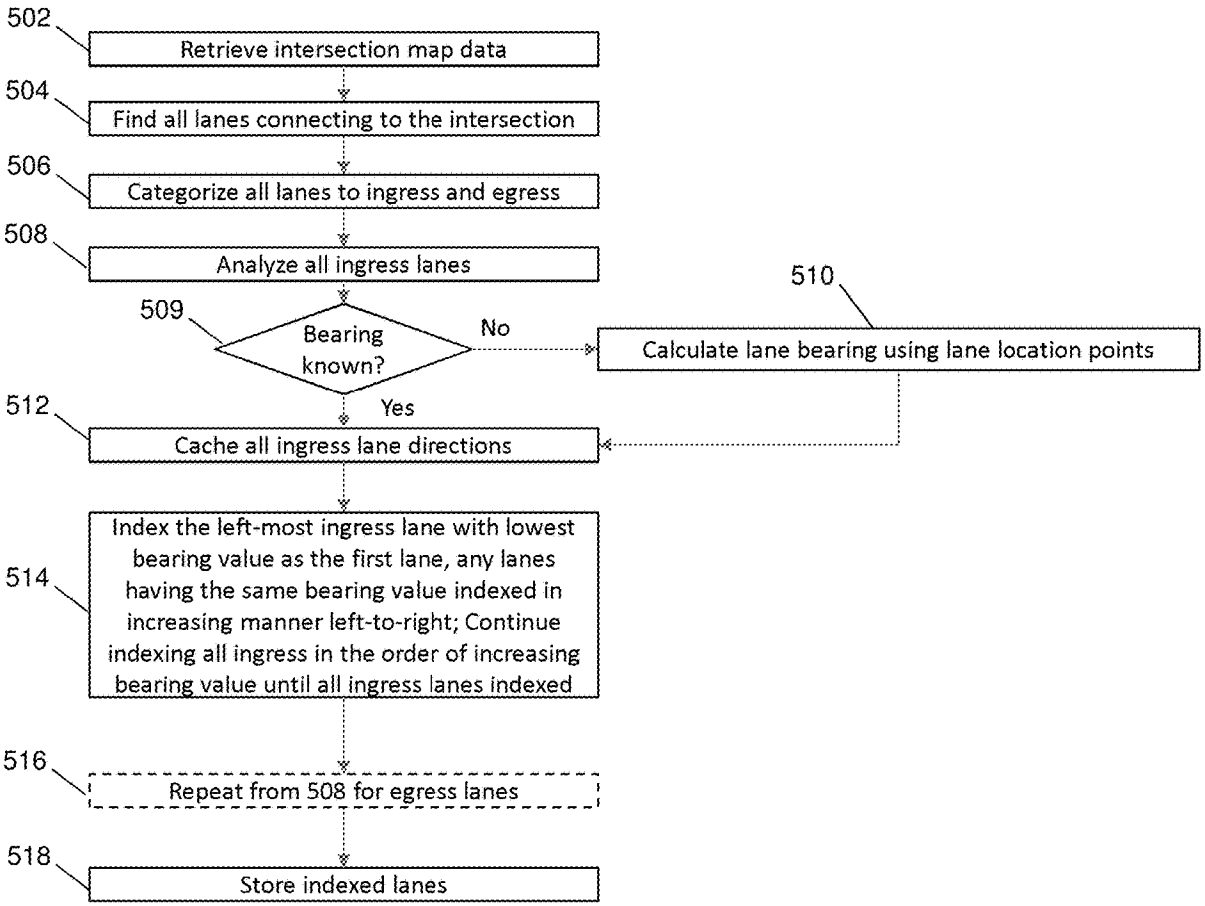
Figure 6:
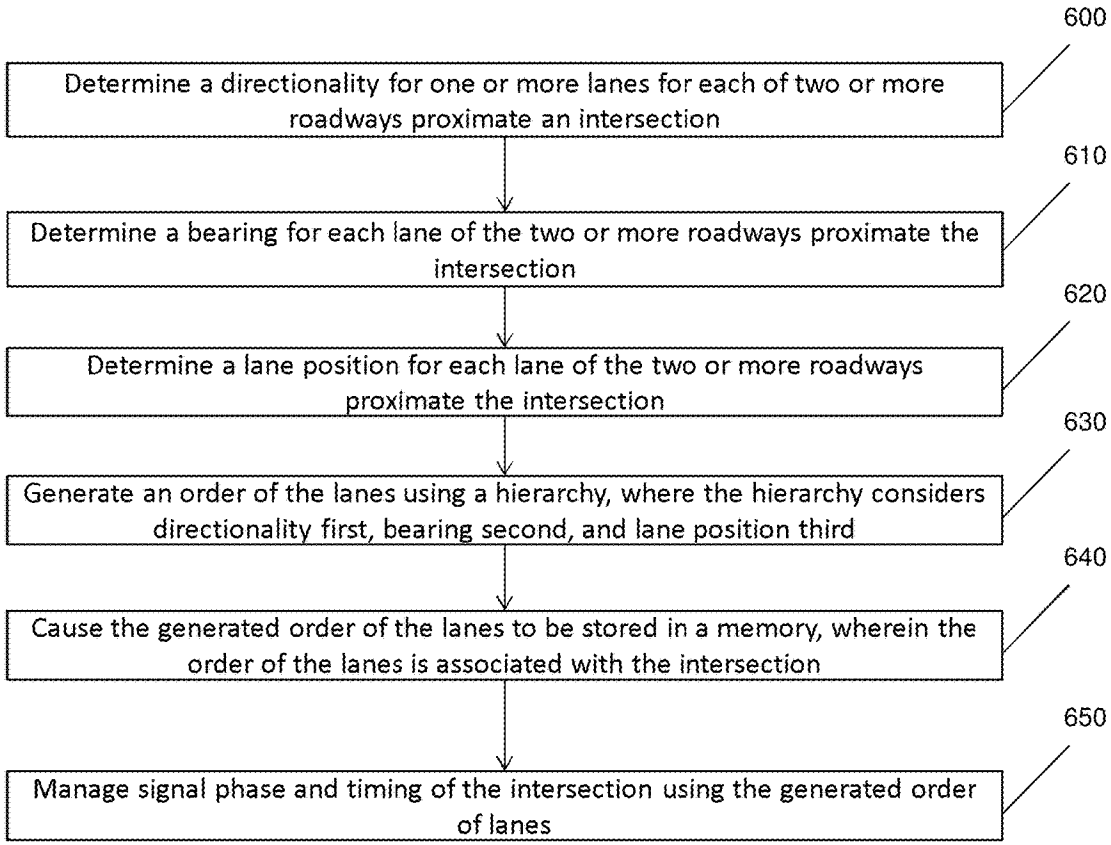

Having thus described example embodiments of the invention in general terms, reference will now be made to the accompanying drawings, which are not necessarily drawn to scale, and wherein:

FIG. 1 illustrates an communication system in accordance with an example embodiment of the present invention;

FIG. 2 is a schematic block diagram of a mobile device according to an example embodiment of the present invention;

FIG. 3 is a schematic illustration of an intersection including traffic lights and traffic phases through the intersection according to an example embodiment of the present invention;

FIG. 4 is a schematic illustration of an intersection including lanes having directionality and bearing, where the lanes are identified according to example embodiments of the present invention;

FIG. 5 is a flowchart of a method for identifying and indexing lanes of an intersection according to an example embodiment of the present invention; and FIG. 6 is a flowchart of another method for identifying and indexing lanes of an intersection according to an example embodiment of the present invention.

DETAILED DESCRIPTION

Some example embodiments of the present invention will now be described more fully hereinafter with reference to the accompanying drawings, in which some, but not all embodiments of the invention are shown. Indeed, various embodiments of the invention may be embodied in many different forms and should not be construed as limited to the example embodiments set forth herein; rather, these example embodiments are provided so that this disclosure will satisfy applicable legal requirements. Like reference numerals refer to like elements throughout. As used herein, the terms "data," "content," "information" and similar terms may be used interchangeably to refer to data capable of being transmitted, received and/or stored in accordance with embodiments of the present invention.

Additionally, as used herein, the term 'circuitry' refers to (a) hardware-only circuit implementations (e.g., implementations in analog circuitry and/or digital circuitry); (b) combinations of circuits and computer program product(s) comprising software and/or firmware instructions stored on one or more computer readable memories that work together to cause an apparatus to perform one or more functions described herein; and (c) circuits, such as, for example, a microprocessor(s) or a portion of a microprocessor(s), that require software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. As another example, the term 'circuitry' as used herein also includes, for example, a baseband integrated circuit or applications processor integrated circuit for a mobile phone or a similar integrated circuit in a server, a cellular network device, other network device, and/or other computing device.

Example embodiments of the present invention may be used in conjunction with, or implemented by, a plurality of components of a system for identifying, controlling, cataloging, and maintaining lane identification information for one or more intersections. The lane identification information may be used to facilitate one or more traffic signals or traffic lights controlling traffic flow at the respective intersections. According to some embodiments as illustrated in FIG. 1, a system that may benefit from example embodiments of the present invention may include a traffic controller 10 which controls the traffic signals at an intersection, such as through the traffic light signal phase and timing, together with sequences and patterns of traffic light function. The traffic controller 10 may be located proximate the intersection of the traffic light, or the traffic controller may be located remotely from the controlled traffic light and in communication with the traffic light through various types of wired or wireless communications, as further described below. The system may further include a network server 20 that is in communication with the traffic controller, such as via network 30, to provide information and commands to the traffic controller, and/or to receive information and data from the traffic controller, such as traffic volumes, hardware issues, or various other information that may be useful in the control of a traffic system.

Traffic control systems of various embodiments may further include a survey device 25 which may be implemented in some systems for the collection of information at an intersection with regard to a traffic controller 10 and convey information regarding the traffic lights surveyed to the network server 20, such as information regarding the lanes traversing an intersection. The survey device 25 may be implemented in scenarios in which the traffic controller 10 may not provide all of the information that may be used by the network server to establish traffic patterns and traffic light phases, such that the survey device 25 may supplement some traffic controllers, while other traffic controllers may provide all necessary information to the network server that is required for the traffic control system.

Communication may be supported by network 30 as shown in FIG. 1 that may include a collection of various different nodes, devices, or functions that may be in communication with each other via corresponding wired and/or wireless interfaces, or in ad-hoc networks such as those functioning over Bluetooth®. As such, FIG. 1 should be understood to be an example of a broad view of certain elements of a system that may incorporate example embodiments of the present invention and not an all inclusive or detailed view of the system or the network 30. Although not necessary, in some example embodiments, the network 30 may be capable of supporting communication in accordance with any one or more of a number of first-generation (1G), second-generation (2.G), 2.5G, third-generation (3G), 3.5G, 3.9G, fourth-generation (4G) mobile communication protocols and/or the like.

One or more communication terminals, such as traffic controller 10 may be in communication with the network server 20 via the network 30, and each may include an antenna or antennas for transmitting signals to and for receiving signals from a base site, which could be, for example a base station that is part of one or more cellular or mobile networks or an access point that may be coupled to a data network; such as a local area network (LAN), a metropolitan area network (MAN), and/or a wide area network (WAN), such as the Internet. In turn, other devices (e.g., personal computers, server computers, or the like) may be coupled to the traffic controller 10, network server 20, or survey device 25, via the network 30. By directly or indirectly connecting the survey device 25, the traffic controller 10, the network server 20, and other devices to the network 30, the survey device 25 and traffic controller 10 may be enabled to communicate with the other devices or each other, for example, according to numerous communication protocols including Hypertext Transfer Protocol (HTTP) and/or the like, to thereby carry out various communication or other functions of the traffic controller 10 and/or the survey device 25.

According to some example embodiments, the survey device 25 may be embodied by a mobile terminal which may be a mobile or fixed communication device, and the traffic controller 10 may be embodied by a fixed communication device. Thus, for example, the survey device 25 and traffic controller could be, or be substituted by, any of personal computers (PCs), personal digital assistants (PDAs), wireless telephones, desktop computers, laptop computers, mobile computers, cloud based computing systems, or various other devices or combinations thereof.

Although the survey device 25, traffic controller 10, and network server 20 may be configured in various manners, one example of an apparatus that may function as one of the aforementioned components to facilitate embodiments of the present invention is depicted in the block diagram of FIG. 2. While several embodiments of the apparatus 15 may be illustrated and hereinafter described for purposes of example, other types of terminals, such as server terminals, traffic controller terminals, portable digital assistants (PDAs), all types of computers (e.g., laptops or mobile computers), global positioning system (GPS) devices, or any combination of the aforementioned, and other types of communication devices, may employ embodiments of the apparatus 15 of the present invention. Further, while the traffic controller 10 is generally described as a fixed computing device, example embodiments may include a mobile terminal as illustrated in FIG. 2, or implement one or more features of the mobile terminal, such as the components to facilitate data collection and processing, and the components to facilitate communications, as will be appreciated by one of skill in the art.

The apparatus 15, such as server 20, survey device 25, or traffic controller 10 may, in some embodiments, be a computing device configured to employ an example embodiment of the present invention. However, in some embodiments, the device or controller, referred to collectively as a computing device, may be embodied as a chip or chipset. In other words, the computing device may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The computing device may therefore, in some cases, be configured to implement an embodiment of the present invention on a single chip or as a single "system on a chip." As such, in some cases, a chip or chipset may constitute means for performing one or more operations for providing the functionalities described herein.

FIG. 2 illustrates a computing device 15 which may embody the survey device 25, the traffic controller 10, or the network server 20. The survey device 25, traffic controller 10, and network server 20 may omit certain features, or include additional features not illustrated as required to perform the various operations described below with respect to their functions. The illustrated computing device 15 may include an antenna 32 (or multiple antennas) in operable communication with a transmitter 34 and a receiver 36. The computing device may further include a processor 40 that provides signals to and receives signals from the transmitter and receiver, respectively. The signals may include signaling information in accordance with the air interface standard of the applicable cellular system, and/or may also include data corresponding to user speech, received data and/or user generated data. In this regard, the mobile terminal may be capable of operating with one or more air interface standards, communication protocols, modulation types, and access types. By way of illustration, the computing device 15 may be capable of operating in accordance with any of a number of first, second, third and/or fourth-generation communication protocols or the like. For example, the computing device 15 may be capable of operating in accordance with second-generation (2G) wireless communication protocols IS-136, GSM and IS-95, or with third-generation (3G) wireless communication protocols, such as UMTS, CDMA2000, wideband CDMA (WCDMA) and time division-synchronous CDMA (TD-SCDMA), with 3.9G wireless communication protocols such as E-UTRAN (evolved-UMTS terrestrial radio access network), with fourth-generation (4G) wireless communication protocols or the like.

The processor may be embodied in a number of different ways. For example, the processor may be embodied as various processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like), a hardware accelerator, and/or the like.

In an example embodiment, the processor 40 may be configured to execute instructions stored in the memory device 60 or otherwise accessible to the processor 40. Alternatively or additionally, the processor 40 may be configured to execute hard coded functionality. As such, whether configured by hardware or software methods, or by a combination thereof, the processor 40 may represent an entity (e.g., physically embodied in circuitry) capable of performing operations according to an embodiment of the present invention while configured accordingly. Thus, for example, when the processor 40 is embodied as an ASIC, FPGA or the like, the processor 40 may be specifically configured hardware for conducting the operations described herein. Alternatively, as another example, when the processor 40 is embodied as an executor of software instructions, the instructions may specifically configure the processor 40 to perform the algorithms and/or operations described herein when the instructions are executed. However, in some cases, the processor 40 may be a processor of a specific device (e.g., a mobile terminal or network device) adapted for employing an embodiment of the present invention by further configuration of the processor 40 by instructions for performing the algorithms and/or operations described herein. The processor 40 may include, among other things, a clock, an arithmetic logic unit (ALU) and logic gates configured to support operation of the processor 40.

The computing device 15 may also comprise a user interface including an output device such as an earphone or speaker 44, a ringer 42, a microphone 46, a display 48, and a user input interface, which may be coupled to the processor 40. The user input interface, which allows the computing device 15 to receive data, may include any of a number of devices allowing the computing device to receive data, such as a keypad 50, a touch sensitive display (not shown) or other input device. In embodiments including the keypad, the keypad may include numeric (0-9) and related keys (#, *), and other hard and soft keys used for operating the computing device 15. Alternatively, the keypad may include a conventional QWERTY keypad arrangement. The keypad may also include various soft keys with associated functions. In addition, or alternatively, the computing device may include an interface device such as a joystick or other user input interface. The computing device may further include a battery 54, such as a vibrating battery pack, for powering various circuits that are used to operate the computing device, as well as optionally providing mechanical vibration as a detectable output. The computing device 15 may also include a sensor 49, such as an accelerometer, motion sensor/detector, temperature sensor, or other environmental sensor to provide input to the processor indicative of a condition or stimulus of the computing device 15. According to some embodiments, the computing device 15 may include an image sensor as sensor 49, such as a camera configured to capture still and/or moving images.

The computing device 15 may further include a user identity module (UIM) 58, which may generically be referred to as a smart card. The UIM may be a memory device having a processor built in. The UIM may include, for example, a subscriber identity module (SIM), a universal integrated circuit card (UICC), a universal subscriber identity module (USIM), a removable user identity module (R-UIM), or any other smart card. The UIM may store information elements related to a mobile subscriber or to a service technician who is assigned the survey device 25, for example. In addition to the UIM, the mobile terminal may be equipped with memory. For example, the computing device 15 may include volatile memory 60, such as volatile Random Access Memory (RAM) including a cache area for the temporary storage of data. The computing device may also include other non-volatile memory 62, which may be embedded and/or may be removable. The non-volatile memory may additionally or alternatively comprise an electrically erasable programmable read only memory (EEPROM), flash memory or the like. The memories may store any of a number of pieces of information, and data, used by the computing device to implement the functions of the computing device. For example, the memories may include an identifier, such as an international mobile equipment identification (IMEI) code, capable of uniquely identifying the mobile terminal. Furthermore, the memories may store instructions for determining cell id information. Specifically, the memories may store an application program for execution by the processor 40, which determines an identity of the current cell, i.e., cell id identity or cell id information, with which the mobile terminal is in communication.

In general, example embodiments of the present invention may provide a method for determining and cataloging an identification of a vehicle travel lanes through intersections in a consistent, repeatable, and reliable manner. The identification schema can be used for signal phase and timing management, and can be used across different systems to maintain a common nomenclature of easily understood lane identification.

In the area of traffic control, intersections are critical to traffic flow management. Intersections having traffic signals that are controlled by traffic network systems can provide intersection movement state control strategies that maximize vehicle capacity, maximize traffic flow efficiency, and improve safety on the associated roads.

Generally, each intersection and traffic control signal has its own assigned signal phase and timing (SPaT) control strategy. With the knowledge of such information, opportunities exist for traffic service providers or traffic management agencies (e.g., departments of transportation) to benefit the automotive industry through maximizing fuel efficiency, minimizing congestion, and improving capacity through avoiding or reducing unnecessary stop-and-go traffic. Heavy traffic can lead to periodic acceleration and deceleration caused by poorly timed traffic signals and inconsistent traffic flow patterns. Minimizing such inefficiencies can reduce travel time and improve safety.

The SAE J2735 standard in Dedicated Short Range Communications (DSRC) Message Set Dictionary defines the Signal Phase and Timing format that describes the current state of a traffic signal system and its phases corresponding to the specific lanes of the intersection. The SPaT information can be delivered through cellular network and/or DSRC while a vehicle is approaching an intersection within a predetermined distance. Unlike SPaT information delivery through a cellular network in which network latency due to signal processing is a concern, DSRC communication minimizes latency and can be considered closer to real-time or immediate than cellular signals.

In addition to SPaT information, the SAE J2735 defines the MAP data format which describes the static physical geometry layout of one or more intersections and is used to convey many types of geographic road information. The MAP message is used along with SPaT information to describe an intersection and current state of control in support of DSRC messages. This requires that the line identification used in the SPaT message for information on a signal group are referring to the same lane identification to describe the correct turn-relations/maneuvers in the map message. Currently, traffic agencies define a set of standard scheme based on signal phases. A traffic signal phase is a timing unit (green, yellow, and red clearance) that facilitates one or more movements at the same time. FIG. 3 illustrates a conventional 8-phase scheme for an intersection with four road segments coming together.

According to the example embodiment of FIG. 3, a major street runs north-south, while a minor street runs east-west. The major street has two northbound lanes, two southbound lanes, one turn lane from south to east and one turn lane from north to west. The minor street has one eastbound lane, one westbound lane, one turn lane from east to north and one turn lane west to south. The illustrated intersection involves eight traffic signal phases, depicted as 301-308, with two phases occurring at a time. For example, phase one, represented at 301 involves allowing a left turn from a northbound lane to a westbound lane. This phase could occur simultaneously with phase five 305, where a southbound vehicle is allowed to turn to an eastbound lane, or phase six 306, where the northbound lanes are allowed to continue north and/or turn from a northbound lane to an eastbound lane. Pedestrian phases represented by 312, 314, 316, and 318, occur together with a respective vehicle traffic phase illustrated by the broken lines. Phases two 302 and six 306 generally represent the major street through movements, while phases four 304 and eight 308 generally represent the minor street through movements. Phases one 301 and five 305 represent the major street left-turn movements, while phases three 303 and seven 307 generally represent the minor street left-turn movements.

Traffic signals or traffic lights, and traffic signal or traffic light controllers, referred to generally herein as traffic controllers, are becoming connected devices, as traffic controllers are more frequently networked with one another on a traffic control system that may be managed by a central traffic control operation. Managing SPaT of traffic lights from a central operation may enable better control over traffic flow through an area, such as an urban or suburban region by having the traffic lights work in cooperation with one another. Proper identification of lanes approaching and departing an intersection may further enhance the ability to manage traffic signal controllers for traffic planning by maximizing throughput of intersections while minimizing traffic congestion and improving traffic efficiency (e.g., fuel efficiency of the traffic). This cooperative operation may increase traffic throughput while reducing fuel consumption and reducing driver irritation. Further, increased traffic throughput may reduce the perceived need for higher-capacity roadways (e.g., through additional lanes or bypass roads) and may lead to cost savings through optimization of existing roadways.

The status of the signal phase and the timing of the state transitions of a traffic light may be collected in real-time (e.g., through traffic controller 10 or survey device 25), or predicted through engineering analysis. The signal phase may include the signal that is presented to a motorist, pedestrian, cyclist, etc., at an intersection. Traffic lights may include various phases. For example, a single-phase traffic light may include a flashing amber or red light indicating right-of-way at an intersection, or a green or red arrow to indicate a protected or prohibited turn. A dual-phase traffic light may include, for example, a pedestrian walk/don't walk signal. A three-phase traffic light may include a conventional green/amber/red traffic light. Embodiments described herein may pertain to all traffic light phases and is not limited to the brief description of phases above. The state transitions may include transitions between phases at a traffic light. A traffic light changing from green to amber is a first state transition, while changing from amber to red is a second state transition. The collected signal phase and timing of the state transitions may be provided through communication protocols either directly to interested users, or through a distribution network shown in FIG. 1.

A traffic light stage may include all traffic lights operating at an intersection, and may consist of a series of non-conflicting phases that run together. A stage may begin with any phase, and may end when that phase begins again. This stage may be depicted by a stage diagram using arrows to depict the movements of vehicles through each traffic light phase of the stage. The time to complete an entire traffic light stage is considered the "cycle time," which may be varied by a traffic controller depending on traffic patterns, as will be described further below.

According to embodiments described herein, traffic lights and traffic light controllers may be assigned specific identification information to indicate the intersection related to the traffic lights. However, traffic controllers often do not identify, nor are they cataloged to include information regarding specific lanes in the road network that are controlled by the traffic light associated with the traffic controllers. In such situations, traffic monitoring municipalities or traffic control companies may have to physically go to an intersection to map the relationship between the controlling traffic lights and the specific lanes that are being controlled. Further, adding signal phase and timing information from these intersections through manual collection can be tedious. This manual process can be time consuming, costly, and prone to error.

As noted above, embodiments described herein may identify and catalog or index the identities of lanes that approach and depart from an intersection in a consistent and repeatable manner that provides uniform nomenclature for the lanes of an intersection. This uniform nomenclature for intersections enables more efficient and effective traffic management across multiple traffic-controlling systems, infrastructures, and agencies such as departments of transportation.

The ability to uniquely and consistently identify each individual lane of an intersection facilitates better, granular control of traffic lights that can control individual or groups of lanes. Traffic light control that has the ability to identify and manage individual lanes of traffic or groups of similar traffic lanes (e.g., two adjacent, non-turning lanes through an intersection) in phases as illustrated in FIG. 3 to maximize the control over the traffic flow through an intersection. In an example embodiment, turn lanes may be individually controlled by a signal phase for turning, such as in phase one of FIG. 3. The ability to uniquely identify the turn lane for phase one and control the traffic flow of that lane may enable control to provide a protected left turn through the intersection at peak traffic periods throughout a day, while providing an unprotected (e.g., yield to oncoming traffic before turning) turn during off-peak traffic periods. This may facilitate better throughput of the intersection.

While lane identification and indexing may facilitate signal phase and timing and traffic flow management through an intersection, lane identification and indexing may also facilitate the gathering of crowd-sourced information from vehicles, such as vehicle probe data to identify traffic flow and volume through intersections. The lane identification can ensure vehicle movement through an intersection is properly captured and cataloged to the appropriate lane through consistent lane identification and indexing.

Vehicle movement through an intersection may be captured in a variety of manners. For example, vehicle movement can be obtained through data collected from the vehicles as they approach, enter, and depart the intersection. This data may be collected from antenna or sensors arranged to detect an identification tag, such as a radio frequency identification tag (RFID) associated with the vehicle, or other form of identifier associated with each vehicle such as vehicle probe data. Optionally, probe data may be generated based on a mobile terminal carried by a user as they operate a vehicle. Survey device 25 may optionally be used to collect information regarding vehicle movement through intersections which may facilitate the management of traffic flow control using different phases of the traffic signals to control the individually identified lanes.

The unique identification and indexing of lanes of an intersection may provide a well-defined, deterministic methodology of numerically identifying the lanes of an intersection. This provides the opportunity to digitize both ingress and egress lanes of the intersection in a manner not possible with conventional methods. Embodiments described herein can be applied to any intersection geometry without manual intervention. The proposed solution uses map geometry available from a digital map data service provider to identify and index the lanes of an intersection in a manner that can be replicated and scaled globally to include any type of intersection in any region and is stable and consistent with the map geometry data.

Conventionally lanes are not individually considered for phases of movement through an intersection, and the phases are identified only according to the movement through the intersection. This does not provide sufficient granular detail and control over the intersection to maximize efficiency and throughput of the intersection. A local jurisdiction may maintain a database of lanes of an intersection; however, these local jurisdictions may have differing nomenclatures and databases not accessible to regional, national, or global providers. The lack of a standard, universal nomenclature for lanes of an intersection renders the efficient management of intersections on a large scale difficult or impossible.

Methods described herein provide lane identification and indexing using dedicated short range communications (DSRC) and wireless communications for signal phase and timing and map data service providers. Further, automotive manufacturers and automotive suppliers and service provider can use the information generated for vehicle-to-infrastructure or vehicle-to-vehicle applications as may be necessary for autonomous or semi-autonomous vehicle applications. Embodiments use geometry and directionality of lanes at an intersection to generalize the process of indexing lanes to any type of intersection with any number of lanes, any number of approaches, any allowed maneuvers, etc. The method provided herein can be applied on any intersection from the simplest to the most complex.

Example embodiments described herein uses a series of rules and a hierarchy to identify and define a unique identification for each lane through an intersection. A traffic light intersection cluster may be defined as a set of traffic lights within a pre-determined radius. This can include any number of traffic light groups, as long as no group is more than the pre-determined distance away from its closest neighboring group. The cluster may be identified through a reference point, which is roughly the center of the traffic light locations.

Each traffic light intersection cluster has a set of roadways or road segments that take vehicles toward the intersection (ingress) or away from the intersection (egress). The lanes that make up these road segments are defined as part of the intersection. All turn-pocket lanes (lanes existing only proximate the intersection specifically intended for turns) as well as traversable shoulder lanes, bus lanes, or any other lanes which may be used by a vehicle are included in the lane identification of the intersection. The length of the road segments used in the methods described herein for lane identification indexing may be configurable. For example, in a dense urban environment, the length of road segments related to an intersection may be relatively small due to the dense volume of intersections in a relatively small area, while a high-speed highway intersection may have a longer length of road segment as vehicles are traversing much further distances during brief time periods approaching the intersections. Each lane of the intersection has the following characteristics inherent to its geometry and use: Directionality (e.g., ingress or egress); Bearing (compass direction heading); and Lane Position (among the lanes sharing directionality and bearing).

The directionality of a lane is a Boolean value which is either ingress, or toward an intersection, or egress, away from an intersection. The bearing is measured as an angle from zero to a measurement just short of 360 degrees, where that measurement may be the measurable tolerance of the bearing, such as 359.999°. A direction may be selected as the zero degree measurement, such as the cardinal direction of north, where the degree measurement may increase clockwise around the compass directions, such that east is 90°, south is 180°, and west is 270°. The bearing of a lane may be determined based on the last line segment direction and angle relative to north. The last line segment of the lane may be defined as the line connecting the last two points defining the lane proximate the intersection. The angle between this line and due north can be found using various map distance formulae, including Haversine or Vincenty, based on precision requirements. The lane position along a directed road segment is the numerical position, from left (or in an alternate process, from right), of the lane along the road segment that it is on. For example, if there are three lanes in the same direction, the left-most lane is labeled 1, the center lane labeled 2, and the right-most lane labeled 3. Another example with five lanes in the same direction would have the left-most lane labeled 1, the left-center lane 2, the center lane as 3, the right-center lane as 4, and the right-most lane labeled 5. If there is only a single lane, it is simply labeled 1. The methods described herein may be applied to regions of right-hand driving (i.e., driving in the right-hand lanes) or left-hand driving (i.e., driving in the left-hand lanes). While no adjustment is absolutely necessary, for consistency between standards, it may be desirable to reverse the direction-based features in the procedure. For example, the lane position may be incremented from right to left in a first region, or left to right in a second region having an opposite-handed driving convention.

The indexing procedure of lanes involves a sorting of the lanes based on a hierarchy of the aforementioned characteristics of each lane. All of the lanes within an intersection may be sorted according to the following rules: Directionality—ingress, then egress (though egress may be optional); Bearing—in increasing value from 0° to just short of 360°; and Lane Position along directed road segment, from left-most lane to right-most lane or vice-versa.

FIG. 4 illustrates an example embodiment of the lanes of an intersection indexed according to the above-described methodology. First, the ingress lanes are considered, which are all lanes heading toward the intersection. Lane bearing is calculated with a true-north-bound lane receiving a bearing value of zero. The lowest bearing value having the lower lane index number. If two lanes have the same direction (e.g., 1 and 2), they are indexed in the order of counter-clockwise (or clockwise in an alternative embodiment). This routine is continued for all lanes in order to establish their unique identifier. As illustrated in FIG. 4, the ingress lanes are each numbered ahead of any of the egress lanes, 1 through 8 versus 9 through 16. The northbound lanes are numbered first, with the eastbound next (bearing value=90), the southbound lanes next (bearing value=180), and finally the westbound lanes (bearing value=270). The left-most lane of each directionally-equivalent lane group is given the lowest number of that group, with an increase as the lanes progress right. Hence the ingress, north bound (bearing value=0), left-most lane is identified as lane 1, while the right lane is identified as lane 2.

Once the ingress lane identification and indexing is complete, the egress lanes may optionally be indexed. The identification and indexing of egress lanes may not be necessary; however, embodiments described herein can be applied to such identification and indexing which may facilitate traffic flow management. As shown in FIG. 4, the northbound egress lanes are numbered first of the egress lanes, with the left most lane receiving the lowest number, in the same manner as the ingress lanes.

The resulting ordered set of lanes are then numbered 1 through N, and this index may be referred to as the intersection lane identification (ILID) number. The mapping of the lane geometries and their attributes to the ILID may be the output of the aforementioned method, which can then be used for signal phase and timing and traffic flow management by any jurisdiction: local, regional, global, etc. This method ensures that all ingress lanes will be indexed first, followed by all egress lanes if necessary. Additionally, this method ensures a deterministic result that is both reproducible and logical. By defining the rules of identification and indexing, any intersection may be identified and indexed in the same manner. This method can be applied to 3-way, 4-way, 5-way, 6-way, and other types of intersections without requiring modification of the rules.

While FIG. 4 illustrates a simplified version of an intersection, example embodiments may include intersections of road segments, where there are one or more assigned lane identification numbers in dependence of the traffic light(s) at the intersection. For example, there may be multiple traffic lights in a single direction and/or pedestrian traffic lights (as shown in FIG. 3), and there may also be video, audio, and/or loop sensors associated with traffic lights and/or traffic lanes. In this manner, there may be a highly complex intersection of a plurality of through-traffic lanes, right and left turn lanes, pedestrian pathways/lights, bus lanes, bike lanes, etc. However, the method of example embodiments described herein may be applied in order to efficiently and repeatably generate lane identification numbers and index the pathways through the intersection for efficient management of traffic flow through the intersection.

FIGS. 5 and 6 are flowcharts illustrative of a system, method, and program product according to example embodiments of the invention. The flowchart operations may be performed by a computing device, such as computing device 15 of FIG. 2, as operating over a communications network, such as that shown in FIG. 1. It will be understood that each block of the flowcharts and combinations of blocks in the flowcharts may be implemented by various means, such as hardware, firmware, processor, circuitry, and/or other device associated with execution of software including one or more computer program instructions. For example, one or more procedures described above may be embodied by computer program instructions. In this regard, the computer program instructions which embody the procedures described above may be stored by a memory device of an apparatus employing an embodiment of the present invention and executed by a processor in the apparatus. As will be appreciated, any such computer program instructions may be loaded onto a computer or other programmable apparatus (e.g., hardware), such as depicted in FIG. 2, to produce a machine, such that the resulting computer or other programmable apparatus embody means for implementing the functions specified in the flowchart blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowchart blocks.

Accordingly, blocks of the flowchart support combinations of means for performing the specified functions, combinations of operations for performing the specified functions and program instruction means for performing the specified functions. It will also be understood that one or more blocks of the flowchart, and combinations of blocks in the flowcharts, can be implemented by special purpose hardware-based computer systems which perform the specified functions, or combinations of special purpose hardware and computer instructions.

An example embodiment of the methods described herein for identifying and indexing the lanes of an intersection is shown in the flowchart of FIG. 5. According to the depicted method, intersection map data may be retrieved at 502. This information may be retrieved from, for example, a map service provider database. All lanes connecting to the intersection may be found at 504, where each lane connecting to the intersection is categorized at 506 to either ingress (e.g., toward the intersection) or egress (e.g., away from the intersection). The ingress lanes may be analyzed initially at 508, and at 509 it may be established as to whether the bearing of each lane is known. The bearing of the lanes may be identified in the map data from the map service provider. However, in some cases, the bearing may not be known and it may require calculation at 510. Once the bearing for each lane is known, all ingress lane directions may be cached at 512. The left-most ingress lane with the lowest bearing value may be identified as the first lane at 514, and any lanes having the same bearing value indexed incrementally in order from left to right. Lanes are indexed according to increasing value of the bearing until all ingress lanes are indexed at 514. The process of flowchart blocks 508-514 may be optionally be repeated for all egress lanes at 516. Upon all lanes that require identification and indexing being appropriately identified and indexed, the index of identified lanes for the intersection may be stored at 518.

The flowchart of FIG. 6 illustrates another example embodiment of a method for identifying an indexing the lanes of an intersection. At 600, a directionality for one or more lanes for each of two or more roadways proximate an intersection may be established. At 610, a bearing for each lane of the two or more roadways may be determined based on a vector of the lane direction relative to a compass direction. A lane position for each lane of the two or more roadways may be determined at 620, such that each lane is identified relative to other lanes having the same bearing and the same direction. An order of the lanes may be generated at 630 using a hierarchy, where the hierarchy considers the directionality first, the bearing of the lane second, and the lane position relative to other lanes sharing the direction and bearing third. The generated order of lanes may be stored in a memory, where the order of the lanes of the intersection are associated with the intersection at 640. At 650, the generated order of lanes may be used in the management of signal phase and timing of the intersection.

In an example embodiment, an apparatus for performing the method of FIGS. 5 and 6 above may comprise a processor (e.g., the processor 40) configured to perform some or each of the operations (502-518 and/or 600-650) described above. The processor may, for example, be configured to perform the operations (502-518 and/or 600-650) by performing hardware implemented logical functions, executing stored instructions, or executing algorithms for performing each of the operations. Alternatively, the apparatus may comprise means for performing each of the operations described above. In this regard, according to an example embodiment, examples of means for performing operations 502-518 and/or 600-650 may comprise, for example, the processor 40 and/or a device or circuit for executing instructions or executing an algorithm for processing information as described above.

As shown, through the identification and indexing of lanes of an intersection, used in conjunction with monitoring of vehicle paths through intersections based on traffic light states, a complete model of the intersection can be built and modeled to optimize traffic flow. Information from all intersections under the control of a traffic control entity (e.g., municipality or commercial entity) can be compiled to create a traffic flow model that may optimize traffic flow through an urban or suburban environment based on a time of day, event, or other traffic-influencing factor, in order to maximize throughput on existing roadways, minimize fuel consumption, and minimize driver frustration.

As described above and as will be appreciated by one skilled in the art, embodiments of the present invention may be configured as a system, method or electronic device. Accordingly, embodiments of the present invention may be comprised of various means including entirely of hardware or any combination of software and hardware. Furthermore, embodiments of the present invention may take the form of a computer program product on a computer-readable storage medium having computer-readable program instructions (e.g., computer software) embodied in the storage medium. Any suitable computer-readable storage medium may be utilized including hard disks, CD-ROMs, optical storage devices, or magnetic storage devices.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus comprising at least one processor and at least one memory including computer program code, the at least one memory and the computer program code configured to, with the at least one processor, cause the apparatus to at least perform:

determine a directionality for one or more lanes for each of two or more roadways proximate an intersection, wherein directionality is one of toward the intersection or away from the intersection;

determine a bearing for each lane of the two or more roadways proximate the intersection, where the bearing is informed by the directionality;

identify the lanes using a hierarchy, wherein the hierarchy considers a predetermined order of directionality and bearing;

cause the identification of the lanes to be stored in a memory, wherein the identification of the lanes is associated with the intersection; and manage at least one of signal phase and timing or traffic planning of the intersection using the identification of the lanes.

2. The apparatus of claim 1, wherein causing the apparatus to determine a bearing of each lane comprises causing the apparatus to:

determine, for each lane, a compass bearing of a vector direction of the lane; and assign a value to the compass bearing for each lane.

3. The apparatus of claim 2, wherein the cardinal direction North has a value of zero, and the assigned value to the compass bearing for each lane comprises a degree measurement from north between zero and a finite unit of measure less than 360 degrees, wherein the finite unit of measure is the measurable tolerance of the determined compass bearing.

4. The apparatus of claim 3, wherein causing the apparatus to identify the lanes using the hierarchy comprises causing the apparatus to:

sort the lanes according to directionality, wherein lane directionality toward the intersection is prioritized ahead of lane directionality away from the intersection; and sort the lanes sorted by directionality by bearing, wherein lower bearing values are prioritized over higher bearing.

5. The apparatus of claim 1, wherein the apparatus is further caused to:

determine a relative lane position for each lane of the two or more roadways proximate the intersection, wherein to identify the lanes, the hierarchy considers directionality first, bearing second, and lane position third.

6. The apparatus of claim 1, wherein directionality for one or more lanes for each of two or more roadways proximate an intersection is established in response to probe data from vehicles traveling through the intersection.

7. The apparatus of claim 1, wherein causing the apparatus to identify the lanes using a hierarchy comprises causing the apparatus to numerically order the lanes using the hierarchy.

8. A method comprising:

determining a directionality for one or more lanes for each of two or more roadways proximate an intersection, wherein directionality is one of toward the intersection or away from the intersection;

determining a bearing for each lane of the two or more roadways proximate the intersection, where the bearing is informed by the directionality;

numerically identifying the lanes using a hierarchy, wherein the hierarchy considers a predetermined order of directionality and bearing;

causing the numeric identification of the lanes to be stored in a memory, wherein the order of the lanes is associated with the intersection; and managing at least one of signal phase and timing or traffic planning of the intersection using the numeric identification of the lanes.

9. The method of claim 8, wherein determining a bearing of each lane comprises:

determining, for each lane, a compass bearing of a vector direction of the lane; and assigning a value to the compass bearing for each lane.

10. The method of claim 9, wherein the cardinal direction north has a value of zero, and the assigned value to the compass bearing for each lane comprises a degree measurement from north between zero and a finite unit of measure less than 360 degrees, wherein the finite unit of measure is the measurable tolerance of the determined compass bearing.

11. The method of claim 10, wherein numerically identifying the lanes using the hierarchy comprises:

sorting the lanes according to directionality, wherein lane directionality toward the intersection is prioritized ahead of lane directionality away from the intersection; and sorting the lanes sorted by directionality by bearing, wherein lower bearing values are prioritized over higher bearing values.

12. The method of claim 11, further comprising:

determining a relative lane position for each lane of the two or more roadways proximate the intersection, wherein to numerically identify the lanes, the hierarchy considers directionality first, bearing second, and lane position third.

13. The method of claim 8, wherein directionality for one or more lanes for each of two or more roadways proximate an intersection is established in response to probe data from vehicles traveling through the intersection.

14. The method of claim 8, wherein the bearing for each lane of the two or more roadways proximate the intersection are established in response to probe data from vehicles traveling through the intersection.

15. A computer program product comprising at least one non-transitory computer-readable storage medium having computer-executable program code instructions stored therein, the computer-executable program code instructions comprising program code instructions to:

determine a directionality for one or more lanes for each of two or more roadways proximate an intersection, wherein directionality is one of toward the intersection or away from the intersection;

determine a bearing for each lane of the two or more roadways proximate the intersection, where the bearing is informed by the directionality;

prioritize the lanes using a hierarchy, wherein the hierarchy considers a predetermined order of directionality and bearing;

cause the priority of the lanes to be stored in a memory, wherein the priority of the lanes is associated with the intersection; and manage at least one of signal phase and timing or traffic planning of the intersection using the priority of the lanes.

16. The computer program product of claim 15, wherein the program code instructions to determine a bearing of each lane comprise program code instructions to:

determine, for each lane, a compass bearing of a vector direction of the lane; and assign a value to the compass bearing for each lane.

17. The computer program product of claim 16, wherein the cardinal direction north has a value of zero, and the assigned value to the compass bearing for each lane comprises a degree measurement from north between zero and a finite unit of measure less than 360 degrees, wherein the finite unit of measure is the measurable tolerance of the determined compass bearing.

18. The computer program product of claim 17, wherein the program code instructions to prioritize the lanes using the hierarchy comprise program code instructions to:

sort the lanes according to directionality, with lane directionality toward the intersection is prioritized ahead of lane directionality away from the intersection; and sort the lanes sorted by directionality by bearing, wherein lower bearing values are prioritized over higher bearing values.

19. The computer program product of claim 18, further comprising program code instructions to:

determine a relative lane position for each lane of the two or more roadways proximate the intersection, wherein to numerically identify the lanes, the hierarchy considers directionality first, bearing second, and lane position third.

20. The computer program product of claim 15, wherein directionality for one or more lanes for each of two or more roadways proximate an intersection is established in response to probe data from vehicles traveling through the intersection.

* * * * *